US005377985A

United States Patent [19]

Ohnishi

[11] Patent Number: 5,377,985

[45] Date of Patent: Jan. 3, 1995

[54] HEAD FOR IRON TYPE GOLF CLUB

[75] Inventor: Akio Ohnishi, Kakogawa, Japan

[73] Assignee: Sumitomo Rubber Industries, Ltd., Kobe, Japan

[21] Appl. No.: 93,611

[22] Filed: Jul. 20, 1993

[30] Foreign Application Priority Data

Jul. 28, 1992 [JP] Japan ..... 4-058693[U]

[51] Int. Cl.[6] ..... A63B 53/04

[52] U.S. Cl. ..... 273/169; 273/167 F; 273/167 H

[58] Field of Search ..... 273/77 R, 77 A, 167 R, 273/167 F, 169, 171, 173, 164.1, 193 R, 194 R, 194 A, 167 H

[56] References Cited

U.S. PATENT DOCUMENTS

| | | | |
|---|---|---|---|
| 1,671,956 | 5/1928 | Sime | 273/169 X |
| 2,087,685 | 7/1937 | Hackney | 273/169 X |
| 2,254,528 | 9/1941 | Hoare | 273/169 |
| 2,846,228 | 8/1958 | Reach | 273/169 |
| 3,419,275 | 12/1968 | Winkleman | 273/171 |
| 3,814,437 | 6/1974 | Winquist | 273/169 X |
| 3,941,390 | 3/1976 | Hussey | 273/169 |
| 3,995,865 | 12/1976 | Cochran et al. . | |
| 4,792,139 | 12/1988 | Nagasaki | 273/167 H |
| 4,883,274 | 11/1989 | Hsien | 273/171 X |
| 4,938,470 | 7/1990 | Antonious | 273/169 X |
| 5,193,805 | 3/1993 | Solheim | 273/169 X |

FOREIGN PATENT DOCUMENTS

| | | | |
|---|---|---|---|
| 0285844 | 10/1988 | European Pat. Off. | 273/169 |
| 1232651 | 5/1971 | United Kingdom | 273/169 |
| 2174009 | 10/1986 | United Kingdom | 273/167 F |
| 2251556 | 7/1992 | United Kingdom | 273/167 R |
| WO92015374 | 9/1992 | WIPO | 273/171 |

*Primary Examiner*—Sebastiano Passaniti
*Attorney, Agent, or Firm*—Armstrong, Westerman, Hattori, McLeland & Naughton

[57] ABSTRACT

A head body portion comprises a plate-shaped face wail portion of approximately 2 mm to approximately 3.5 mm in thickness and a shaft connecting portion. The face wall portion is provided with weighting projections at four places thereof, toe side upper and lower portions and heel side upper and lower portions of a rear portion thereof.

13 Claims, 5 Drawing Sheets

HEAD FOR IRON TYPE GOLF CLUB

BACKGROUND AND SUMMARY OF THE INVENTION

The present invention relates to a head for an iron type golf club.

In order to increase the moments of inertia around the axes of the club head which pass through the gravitational center thereof, and are horizontal and vertical to the lined face grooves thereof, a conventional iron type golf club head is arranged as described and shown in, for example, the Japanese Patent Application Opening Gazette No. 63-27986 and the Japanese Utility-Model Application Opening Gazette No. 62-92857. That is to say, as shown in FIG. 9 illustrating such prior art, a rear portion b of a club head is reduced in the thickness of the middle portion thereof to form a recessed portion a therein, and the material corresponding in quantity to the reduced thickness of the rear portion is uniformly applied to the peripheral portion thereof, thereby allowing the rear portion to be provided with a peripheral thicker portion c.

However, an increase in the thickness of a portion A adjacent to the horizontal axis X of the club head which passes through the gravitational center G thereof in parallel with the lined face grooves therein does not greatly contribute to an enhancement in the moment of inertia about the horizontal axis X.

On the other hand, an increase in the thickness of a portion B adjacent to the vertical axis Z of the club head which passes through the gravitational center G thereof, and is perpendicular to the lined face grooves therein is not effective for an increment in the moment of inertia, Mz about the vertical axis X.

It is therefore an object of the present invention to provide an improved head for an iron type golf club, which is sufficiently increased in the moment of inertia about each of the parallel axis thereof with the lined face grooves thereof and the vertical axis thereof to the lined face grooves, thereby allowing an increment in the area of the sweet spot thereof to diminish aberration of the flying direction of the ball when the ball has been subjected to an erroneous shot, and to prevent any decline in the flying distance of the ball.

BRIEF DESCRIPTION OF THE DRAWINGS

The present invention will be described with reference to the accompanying drawings, in which.

DETAILED DESCRIPTION OF THE PREFERRED EMBODIMENTS

Preferred embodiments of the present invention will be described in detail with reference to the accompanying drawings.

Figure 1:
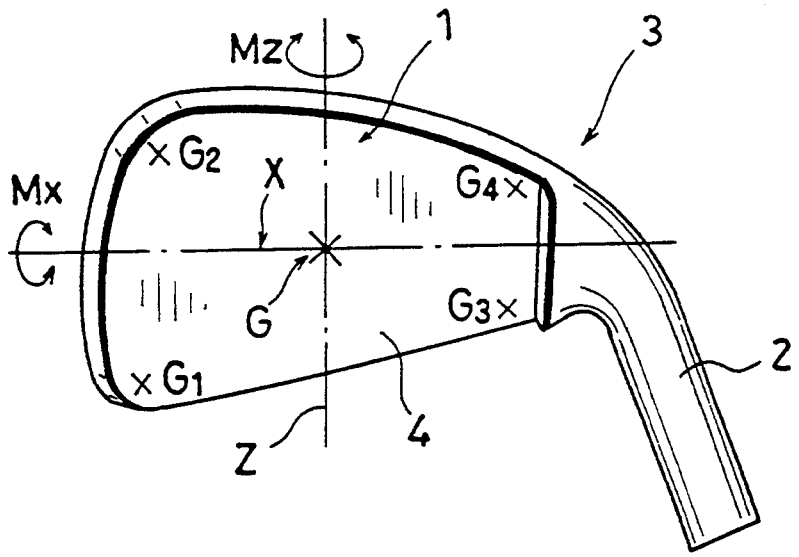
FIG. 1 is a basic explanatory diagram of the club head of the present invention.

In FIG. 1 which is an explanatory diagram of the present invention, a face wall portion 1 in a plate-shaped configuration and a shaft connecting portion 2 are integrated with each other to form a head body portion 3. A rear surface 4 of the face wall portion 1 is weighted in four corner portions thereof which are marked with the letter x in FIG. 1. Specifically, as shown in FIGS. 2 to 5, the face wall portion 1 of the head body portion 3 is formed in a configuration of a plate of approximately 2 mm to approximately 3.5 mm in the thickness T thereof, while at the same time, the rear surface 4 of the face wall portion 1 is formed with weighting projections 6 in four corner places thereof, the toe side upper and lower portions thereof and the heel side upper and lower portions thereof.

The club heads shown in the figures are as viewed from the opposite sides to their ball hitting surfaces. Therefore, their face portions are only depicted in all the figures, and the face portions are formed with the ball hitting surfaces as in the conventional club head. The weighting projections 6 are located on the opposite sides of the face portions of the club heads, as shown in FIG. 2.

Figure 2:
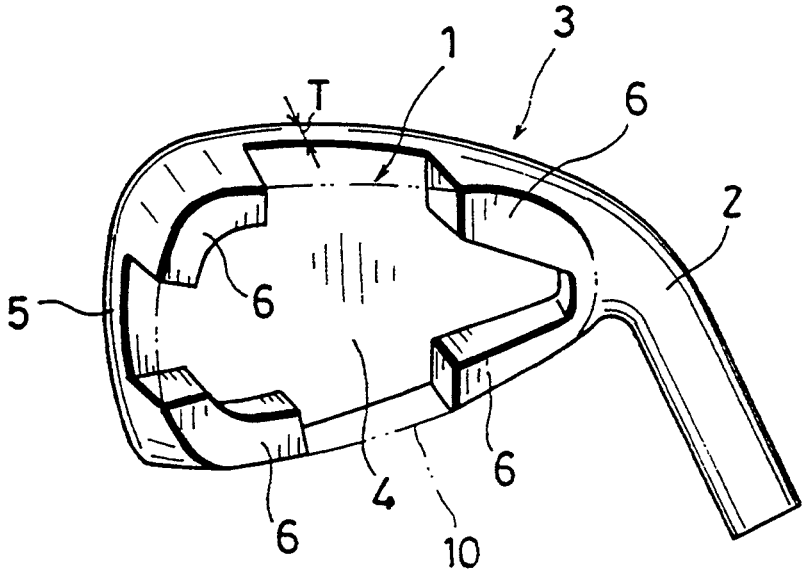
FIG. 2 is a perspective view of the the club head according to a first preferred embodiment of the present invention.
Figure 3:
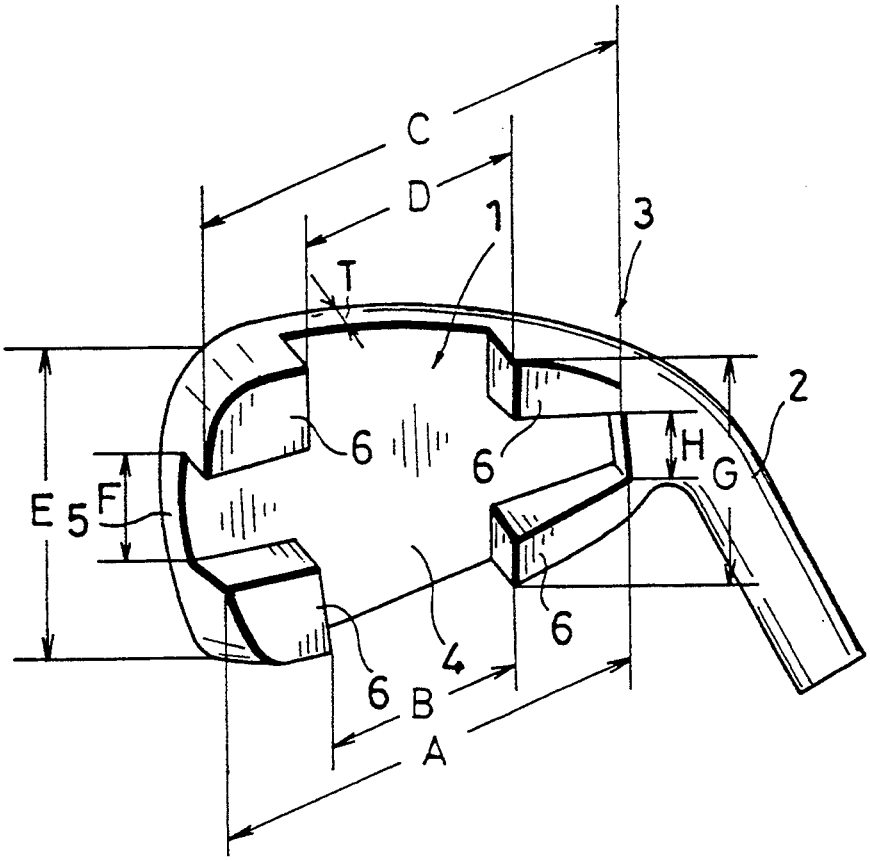
FIG. 3 is a perspective view of the club head according to a second preferred embodiment of the present invention.

In FIG. 2, the projections 6 are curved as a whole in accordance with the outer peripheral configuration of the face wall portion 1 of the club head. However, the projections 6 may be curved in their outer peripheral sides alone in conformity with the outer peripheral configuration of the face wall portion 1 as shown in FIG. 2, while on the other hand, as shown in FIG. 3, the inside portions of the projections 6 may be formed with two planes which intersect at substantially right angles.

Figure 4:
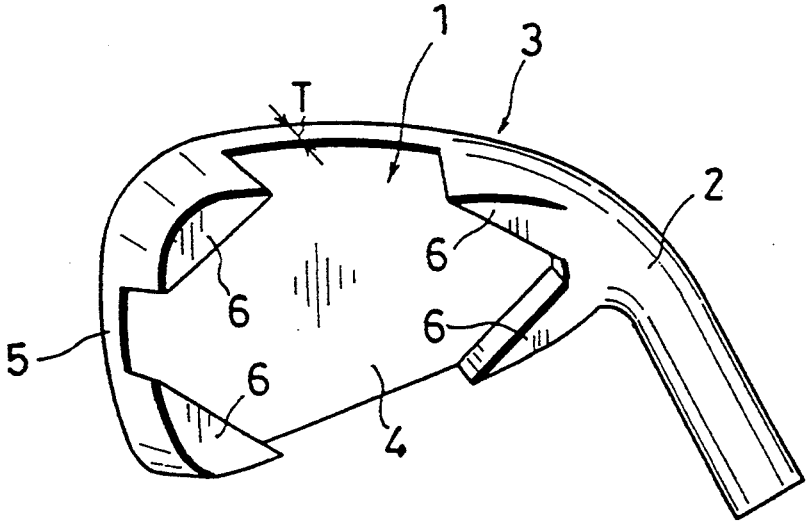
FIG. 4 is a perspective view of the club head according to a third preferred embodiment of the present invention.

Also, as shown in FIG. 4, the projections 6 may preferably be formed in a crescent or triangular configuration as viewed from the rear surface side.

Figure 5:
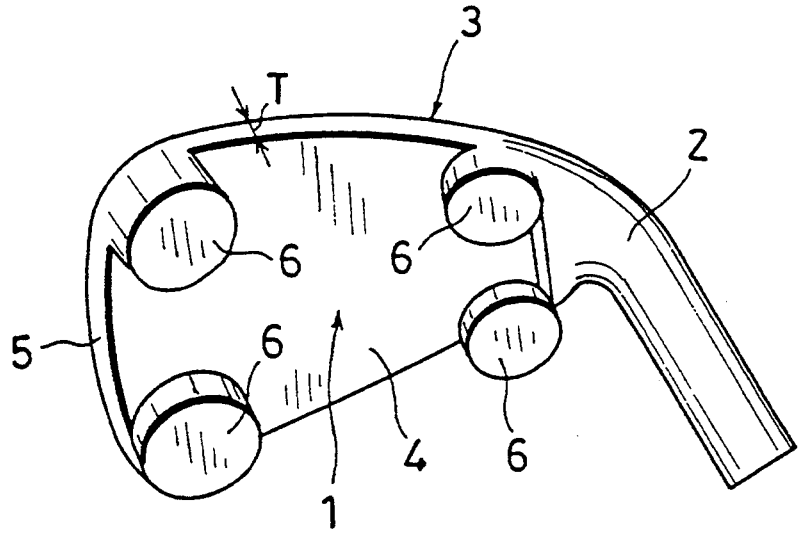
FIG. 5 is a perspective view of the club head according to a fourth preferred embodiment of the present invention.

Alternatively, as shown in FIG. 5, the projections 6 may preferably be shaped in a configuration of a small disk. In this case, referring to the distances as shown in FIG. 3, the distance A between the outer peripheral ends of the projections 6 on the upper surface side of the club head, the distance B between the opposed surfaces of the projections on the upper surface side of the club head, the distance C between the outer peripheral ends of the projections 6 on the sole side of the club head, the distance D between the opposed surfaces of the projections 6 on the sole side of the club head, the distance E between the outer peripheral ends of the projections 6 on the toe side of the club head, the distance F between the opposed surfaces of the projections 6 on the toe side of the club head, the distance G between the outer peripheral ends of the projections 6 on the heel side of the club head, and the distance H between the opposed surfaces of the projections 6 on the heel side of the club head are desired to meet the following requirements.

Figure 6:
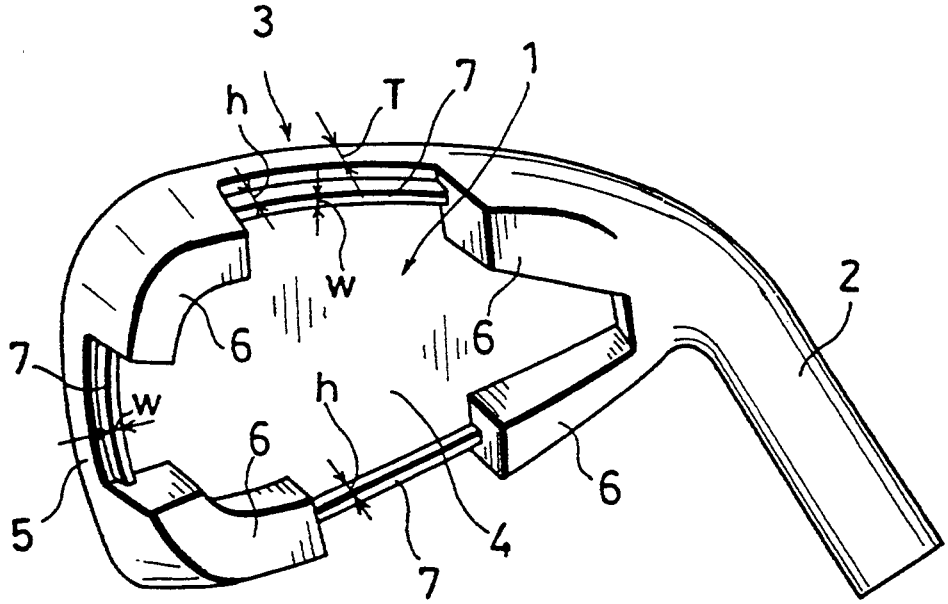
FIG. 6 is a perspective view of the club head according to a fifth preferred embodiment of the present invention.
Figure 7:
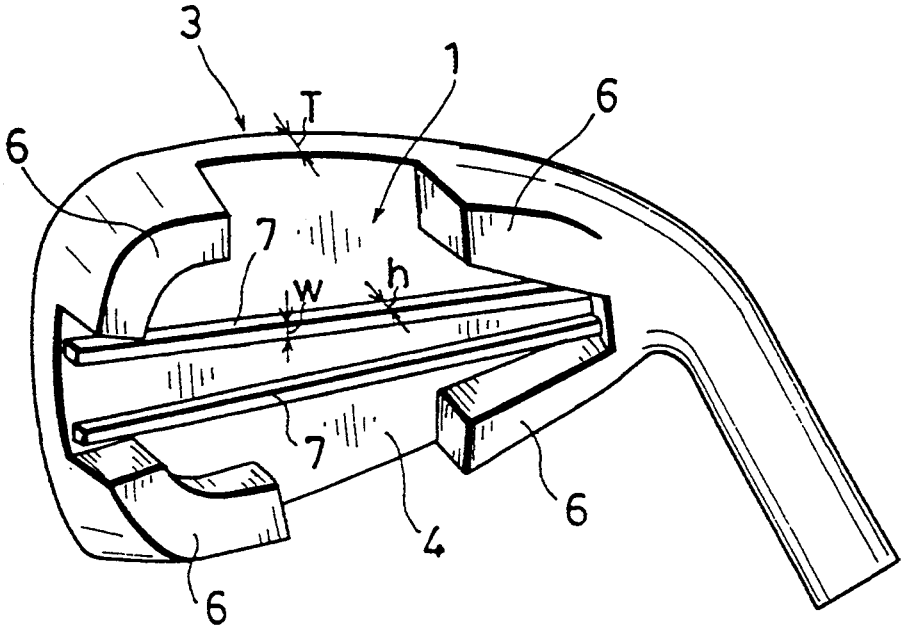
FIG. 7 is a perspective view of the club head according to a sixth preferred embodiment of the present invention.
Figure 8:
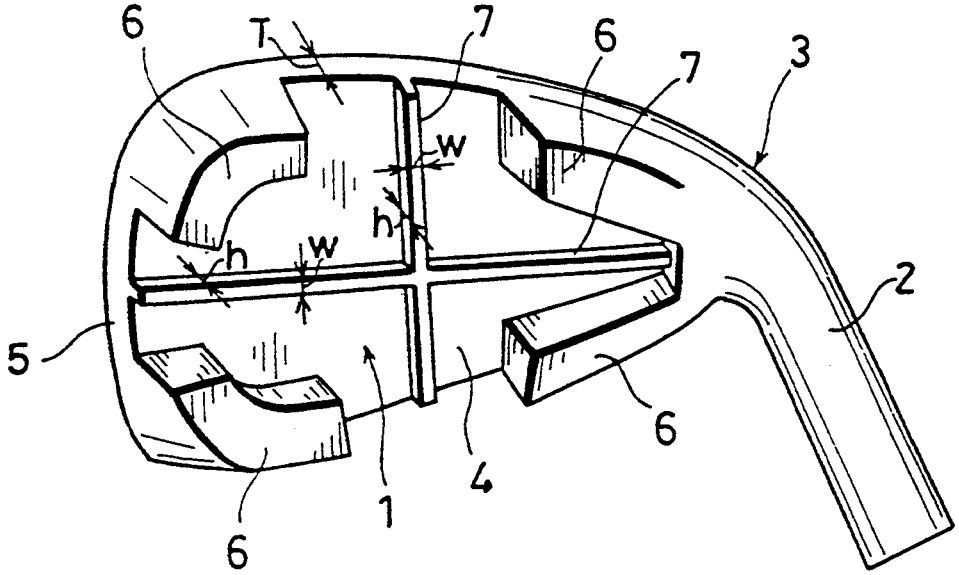
FIG. 8 is a perspective view of the club head according to a seventh preferred embodiment of the present invention.

$90\% \geqq B/A \geqq 40\%$, $90\% \geqq D/C \geqq 40\%$, $90\% \geqq E/F \geqq 30\%$ and $90\% \geqq H/G \geqq 30\%$ In FIGS. 6 to 8 which show other embodiments of the present invention, the rear surface 4 of the face wall portion 1 is integratedly formed with reinforcing ribs 7 of 1 mm to 10 mm in the width w thereof and 0.5 mm to 10 mm in the height h thereof.

FIG. 6 shows the fifth preferred embodiment of the present invention, and in this embodiment, the reinfocing ribs 7 are three in number, and are located such that they respectively connect every two neighboring projections along the outer periphery of the rear surface 4 of the face wall portion 1.

In FIG. 7 which shows the sixth preferred embodiment of the present invention, two reinforcing ribs 7 are substantially horizontally located at a predetermined interval of place across the rear surface 4 of the face wall portion 1.

Moreover, in FIG. 8 which shows the seventh preferred embodiment of the present invention, two reinforcing ribs 7 are arranged such as to cross in the substantially middle portion of the rear surface 4.

Also, in the foregoing embodiments of the present invention which are shown in FIGS. 2 to 8, the projections 6 may give some queer impression as compared with the conventional iron club head. In order to prevent this, a thin covering member 10 of 0.5 mm to 1.5 mm in thickness is preferably secured on the rear surface side. See FIG. 2.

In order to achieve the securing of this covering member 10, bolting, welding, adhesives, pressure fit or other similar means is separately used, or these means are employed in combination. Also, the covering member 10 is shaped such that the middle portion thereof is only recessed, or is streamlined in the configuration thereof, with the roar corner portions thereof swelled, such that the existence of the four projections 6 is indefinably perceived or such that the covering member 10 itself forms a back surface of the club head which is substantially free from a rugged condition is formed for the club head.

In FIG. 1 in which the gravitational centers of the foregoing four weighting projections 6 are represented by means of the marks G1, G2, G3 and G4, and the horizontal axis X and the vertical axis Z respectively pass through the gravitational center G of the entire club head, the gravitational center G of the entire club head, the gravitational centers G1, G2, G3 and G4 of the weighting projections 6 are considerably far away from the horizontal axis X and the vertical axis Z.

As a result, it will be understood that the weight of each projection 6 produces a great effect upon an increase in the moment of inertia, Mx about the horizontal axis X, and the moment of inertia, Mz about the vertical axis Z.

That is to say, on condition that the same weight is applied to each of the projections, the positions of the gravitational centers G1, G2, G3 and G4 of the weighting projections 6 produce the greatest effect upon enhancements in the moments of inertia, Mx and Mz.

The following table shows the measured results of the moments of inertia, Mx and Mz in conventional No. 5 iron club heads (b) (c) and a club head having the present invention applied thereto. In this case, all the club heads are identical in their weight.

TABLE

| | Conventional Club Head (b) | Conventional Club Head (c) | Club Head having the present invention applied thereto (a) |
|---|---|---|---|
| Moment of Inertia Mz | 2300 g-cm$^2$ | 2560 g-cm$^2$ | 2790 g-cm$^2$ |
| Moment of Inertia Mx | 550 g-cm$^2$ | 590 g-cm$^2$ | 660 g-cm$^2$ |
| Total Weight of Club Head | 258 g | 258 g | 258 g |

Figure 9:
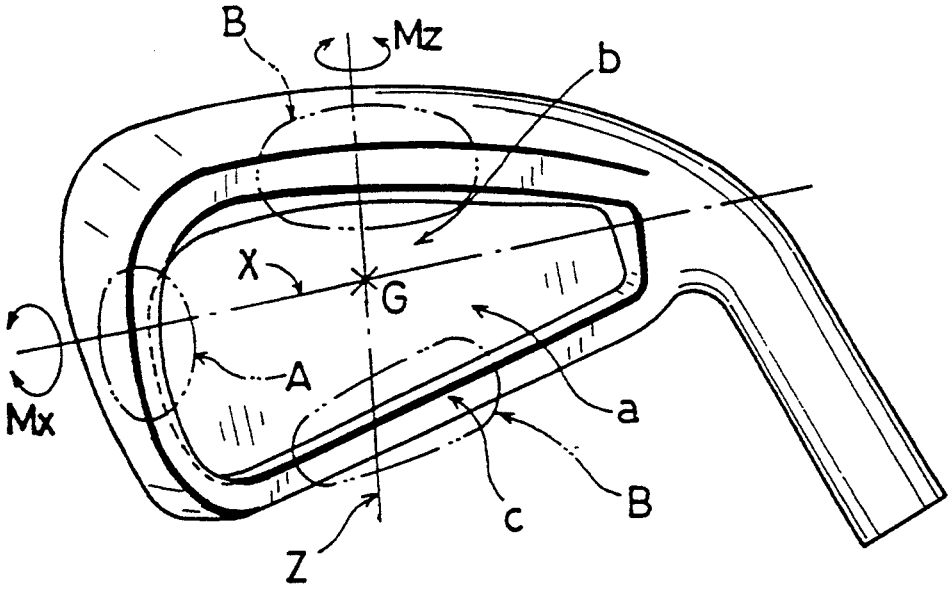
Fig. 9 (PRIOR ART)
FIG. 9 is an explanatory diagram of the conventional club head.

More specifically, the club head (a) in which the present invention is embodied is shaped as illustrated in FIG. 2, and is 3 mm in the thickness T of the face wall portion 1 thereof, while on the other hand, the conventional club head (b) is "Maxfli DP-201" produced by Sumitomo Rubber Industries, Ltd. in which the thickness of a sole side portion thereof is increased as a whole in comparison with other portions thereof, and the other conventional club head (c) is "Maxflo FX-31" also by the same manufacturer, in which weight is evenly distributed over the entire peripheral portion of the rear surface of the club head as shown in FIG. 9.

From the foregoing table, it is understood that in the club head (a) having the present invention applied thereto, the moments of intertia, Mz and Mx are both great as compared with the conventional club heads (b) and (c).

The conventional club head (c) in particular is said to be great in the moments of inertia, Mz and Mx. However, in the club head (a) of the present invention, the moments of inertia, Mz and Mx are respectively increased by approximately 9% and 12% in comparison with the conventional club head (c).

The club heads shown in FIGS. 2 to 8 are manufactured such that the projections 6 and the face wall portion 1 are integrated into a single unit. However, it is alternatively feasible to secure to the face wall portion 1 the projections 6 made separately therefrom. In this case, the projections 6 are desired to be greater in the specific gravity thereof.

As is apparent from the foregoing description, the club head according to the present invention is capable of increasing the moments of inertia, Mx and Mz passing through the gravitational center G thereof as compared with the conventional iron club heads in which their rear portions are reduced in thickness to form recessed portions in the rear portions, and the materials corresponding to the volumes of the recessed portions are evenly distributed at their peripheral portions to form peripheral thicker portions.

As a result, the club head of the present invention is increased in the area of the sweet spot thereof, to thereby diminish aberration of the flying direction of the ball when the ball has been subjected to an erroneous shot, and to prevent any decline in the flying distance of the ball.

Also, if the distances between every two projections 6 in the club head of the present invention are limited, to thereby restrict the size of the projections 6, the club head is markedly enhanced in the moments of inertia Mx and Mz thereof. Thus, the distance A between outer peripheral ends of the projections on the upper side of said rear surface of the head; the distance B between the opposed surfaces of the projections on the upper side of said rear surface of the head; the distance C between the outer peripheral ends of the projections on a sole side of the rear surface of the head; the distance D between the opposed surfaces of the projections of the sole side of the rear surface of the head; the distance E between the outer peripheral ends of the projections on the toe side of the rear surface of the head; the distance F between the opposed surfaces of the projections on the toe side of the rear surface of the head; the distance G between the outer peripheral ends of the projections on the heel side of the rear surface of the head; and, the distance H between the opposed surfaces of the projections on the heel side of the head are, as follows: $90\% \geqq B/A \geqq 40\%$, $90\% \geqq D/C \geqq 40\%$, $90\% \geqq E/F \geqq 30\%$ and $90\% \geqq H/G \geqq 30\%$.

Also, in the club head provided with the reinforcing ribs 7 in the rear surface 4 of the face wall portion 1 thereof, the ribs 7 compensate sufficiently for a shortage of strength thereof which is caused by forming the face wall portion in a plate-shaped configuration.

The club head fitted with the thin covering member 10 remains unchanged in the external appearance thereof from that of the conventional club head.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein. For example, the following modification falls under the present invention.

While the face wall portion 1 itself is equalized in the thickness thereof at any place thereof in the foregoing embodiments of the present invention, the face wall portion 1 itself may be slightly varied in the thickness thereof in places.

Also, the reinforcing ribs 7 may be formed in a cross-sectionally semi-circular or semi-elliptic configuration. Moreover, the reinforcing ribs 7 shown in FIGS. 6 to 8 may be arranged in combination so that they are in a diamond-shaped or checkered configuration or in any other suitable configuration.

I claim:

1. A head for an iron type golf club, comprising a head body portion including a plate-shaped face wall portion of approximately 2 mm to approximately 3.5 mm in thickness and a shaft connecting portion, said face wall portion having a rear surface weighted in four corners thereof with weighting projections at toe side upper and lower portions and heel side upper and lower portions, wherein a distance A between outer peripheral ends of said projections on an upper side of said rear surface of said head, a distance B between opposed surfaces of said projections on said upper side of said rear surface of said head, a distance C between outer peripheral ends of said projections on a sole side of said rear surface of said head, a distance D between opposed surfaces of said projections on said sole side of said rear surface of said head, a distance E between outer peripheral ends of said projections on said toe side of said rear surface of said head, a distance F between opposed surfaces of said projections on said toe side of said rear surface of said head, a distance G between outer peripheral ends of said projections on said heel side of said rear surface of said head, and a distance H between opposed surfaces of said projections of said heel side of said head meet the requirements of $90\% \geqq B/A \geqq 40\%$, $90\% \geqq D/C \geqq 40\%$ $90\% \geqq E/F \geqq 30\%$ and $90\% \geqq H/G \geqq 30\%$.

2. The head for an iron type golf club as set forth in claim 1, wherein said projections are curved in accordance with an outer peripheral configuration of said face wall portion.

3. The head for an iron type golf club as set forth in claim 1, wherein said projections are curved in their outer peripheral sides in conformity with an outer peripheral configuration of said face wall portion, while inside portions of said projections are formed with two planes which intersect at substantially right angles.

4. The head for an iron type golf club as set forth in claim 1, wherein said projections are formed in a crescent configuration as viewed from the rear surface of said head.

5. The head for an iron type golf club as set forth in claim 1, wherein said projections are formed in a disk-shaped configuration.

6. The head for an iron type golf club as set forth in claim 1, wherein said projections and said face wall portion are integrated into a single unit.

7. The head for an iron type golf club as set forth in claim 1, wherein said projections made separately from said face wall portion are secured to said face wall portion.

8. The head for an iron type golf club as set forth in claim 1, wherein said face wall portion is fitted with a thin covering member of 0.5 mm to 1.5 mm in thickness on said surface to cover said weighted four corners.

9. The head for an iron type golf club as set forth in claim 1, wherein reinforcing ribs of 1 mm to 10 mm in width and 0.5 mm to 10 mm in height are attached to said rear surface of said face wall portion.

10. The head for an iron type golf club as set forth in claim 9, wherein said reinforcing ribs are located between every two weighted four corners to connect said four corners.

11. The head for an iron type golf club as set forth in claim 9, wherein said reinforcing ribs are attached to a middle portion of said rear surface of said face wall portion from said toe side to said heel side of said head.

12. The head for an iron type golf club as set forth in claim 9, wherein said reinforcing ribs cross at right angles substantially in a middle portion of said rear surface of said face wall portion.

13. The head for an iron type golf club as set forth in claim 1, wherein said projections are formed in a triangular configuration as viewed from the rear surface of said head.

* * * * *